US011784015B2

(12) United States Patent
Thingstad Pettersen et al.

(10) Patent No.: US 11,784,015 B2
(45) Date of Patent: Oct. 10, 2023

(54) SWITCH-FUSE MODULE

(71) Applicant: ABB Schweiz AG, Baden (CH)

(72) Inventors: Terje Thingstad Pettersen, Skien (NO); Ståle Talmo, Skien (NO); Stanley Lohne, Porsgrunn (NO); Elham Attar, Skien (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/654,109

(22) Filed: Mar. 9, 2022

(65) Prior Publication Data

US 2022/0293367 A1 Sep. 15, 2022

(30) Foreign Application Priority Data

Mar. 11, 2021 (EP) ..... 21162028

(51) Int. Cl.

| | |
|---|---|
| ***H01H 9/10*** | (2006.01) |
| ***H01H 31/00*** | (2006.01) |
| ***H01H 31/12*** | (2006.01) |
| ***H01H 33/56*** | (2006.01) |

(52) U.S. Cl.

CPC ..... *H01H 33/56* (2013.01); *H01H 9/102* (2013.01); *H01H 31/003* (2013.01); *H01H 31/12* (2013.01); *H01H 2033/566* (2013.01)

(58) Field of Classification Search

CPC ..... H01H 33/56; H01H 33/022; H01H 33/22; H01H 9/102; H01H 9/10; H01H 31/003; H01H 31/12; H01H 2033/566; H01H 85/0233; H01H 85/0241; H01H 85/0456; H01H 85/153; H01H 85/204; H01H 85/38

USPC ... 218/43, 44–47, 53, 55, 67–68, 70, 79–80, 218/101

See application file for complete search history.

(56) References Cited

U.S. PATENT DOCUMENTS

| | | | | |
|---|---|---|---|---|
| 4,384,185 | A | 5/1983 | Hall et al. | |
| 4,496,916 | A * | 1/1985 | Carpenter | H01H 9/223 337/6 |
| 9,177,730 | B2 * | 11/2015 | Binnendijk | H01H 1/40 |
| 10,176,959 | B1 * | 1/2019 | Bhalla | H02B 1/04 |
| 10,230,221 | B2 * | 3/2019 | Wu | H02G 3/22 |
| 2002/0066655 | A1 * | 6/2002 | Theaudiere | H01H 9/104 200/47 |

(Continued)

FOREIGN PATENT DOCUMENTS

| | | |
|---|---|---|
| EP | 0517295 A2 | 12/1992 |
| EP | 3780055 A1 | 2/2021 |

OTHER PUBLICATIONS

Extended European Search Report; Application No. 21162028.1; Completed: Oct. 6, 2021; dated Oct. 10, 2021; 7 Pages.

*Primary Examiner* — William A Bolton

(74) *Attorney, Agent, or Firm* — WHITMYER IP GROUP LLC

(57) ABSTRACT

A switch-fuse module and a ring main unit. The switch-fuse module includes: a housing having therein a first enclosure including a first insulating gas and a second enclosure including a second insulating gas; at least one switch disconnector arranged within the first enclosure; and at least one fuse at least partially surrounded by the second enclosure; wherein each of the first insulating gas and the second insulating gas has a global warming potential less than a global warming potential of SF6, and the first enclosure is different and separate from the second enclosure.

21 Claims, 2 Drawing Sheets

(56) References Cited

U.S. PATENT DOCUMENTS

| | | | | |
|---|---|---|---|---|
| 2010/0110616 | A1* | 5/2010 | Edel | H02B 1/18<br>361/642 |
| 2020/0203934 | A1* | 6/2020 | Kozel | H02B 1/38 |

* cited by examiner

SWITCH-FUSE MODULE

TECHNICAL FIELD

Embodiments of the present disclosure relate to a switch-fuse module, in particular a switch-fuse module for use with insulating gases with global warming potential less than global warming potential of SF6, and to a ring main unit including the switch-fuse module.

BACKGROUND

In medium- or high-voltage equipment, the gas sulphur hexafluoride (SF6) plays a key role as an insulating and arc-quenching medium, particularly in a switchgear. In addition to its many advantages in terms of technical properties, SF6 has the disadvantage of having a very high global warming potential. It is a potent greenhouse gas. Therefore, recently, alternative insulating gases such as ketone gases have been investigated.

For medium- or high-voltage equipment, it is desired, from a customer point of view, that the equipment takes up as little floor space as possible or at least does not exceed the size of traditional units, thus enabling the customer to renew existing equipment without additional space requirements, preferably in combination with existing customer components, and from a manufacturer point of view, that existing production lines can be used with as few changes as possible to produce as cost-effectively as possible. This is a challenge in case of alternative gases, since these are assumed to require larger distances for obtaining dielectric properties comparable to those of SF6.

Thus, there is a need for medium- or high-voltage equipment that addresses environmental concerns. There is also a need to provide medium- or high-voltage equipment with low floor space requirement, that can be manufactured in a cost-effective manner.

TERMS AND DEFINITIONS

This application uses terms whose meaning is briefly explained here.

The term axial refers to a longitudinal axis of an element or unit. The term longitudinal refers to a direction in which the element has the greatest spatial extension and/or a symmetry axis. The term lateral refers to a direction perpendicular to the longitudinal axis, in which the object has the second largest extension and/or which is parallel to a horizontal direction when mounted in a regular mounting orientation. An axial direction refers to a direction parallel to the longitudinal axis of the element.

Value ranges defined as x1, or x2, etc. to y1, or y2, etc. mean that the values are within intervals such as x1 to y1, or x1 to y2, or x2 to y1, or x2 to y2, etc.

An x- and z-direction as shown in FIG. 2 may be perpendicular to each other and may define a horizontal or x-z plane. The y-direction may then be a vertical direction, perpendicular to the horizontal plane. A view of the switch-fuse module in a direction perpendicular to z-y plane may be a side view. Accordingly, a footprint may be in the horizontal plane. Similarly, a view of the switch-fuse module in a direction perpendicular to x-y plane may be a front or back view. Terms such as "vertical" and "horizontal" may refer to the respective directions when the switch-fuse module is mounted in a regular mounting orientation in which the module is ready for operation, especially with an operating panel oriented on a vertical front face of the switch-fuse module.

A height of an object may be understood as an object extension in the y direction, a depth may be understood as an object extension in the z direction, and a width may be understood as an object extension in the x direction.

In this document, "or" is understood as a non-exclusive disjunction. Accordingly, the link "A or B" expresses that at least one of the involved statements A, B is true.

Furthermore, the terms "a" or "the", such as in the expression "a fuse" or "the fuse", are used to refer to at least one fuse. The quantity "a" or "the" includes the quantity "at least one". If the term "at least one" is used explicitly, a subsequent use of "a" or "the" does not imply any deviation from the aforementioned principle according to which "a" or "the" is to be understood as "at least one".

The terms "substantially" or "basically" as used herein typically imply that there may be a certain deviation, e.g. up to 1%, up to 3% or up to 10%, from the characteristic denoted with "substantially".

SUMMARY

In view of the above, a switch-fuse module and a ring-main unit having a switch-fuse module according to the claims, are provided.

According to an aspect of the present disclosure, a switch-fuse module is provided. The switch-fuse module includes: a housing having therein a first enclosure including a first insulating gas and a second enclosure including a second insulating gas, at least one switch disconnector arranged within the first enclosure, and at least one fuse at least partially surrounded by the second enclosure. Each of the first insulating gas and the second insulating gas has a global warming potential less than a global warming potential of SF6. The first enclosure is different and separate from the second enclosure.

According to another aspect of the present disclosure, a ring main unit is provided. The ring main unit includes the switch-fuse module.

Some advantages relating to the switch-fuse module and the ring main unit are described as follows.

An advantage is that the configurations of functional units such as cable switching, circuit break and fuse module for ring main units use environmentally friendly gases as dielectric medium.

An advantage is that criteria such as dielectric level, mechanical linkage, and requirements of a 12 kV and/or 24 kV ring main unit may be provided for SF6 free equipment.

An advantage is that the equipment production is possible using existing production lines with as few changes as possible to produce as cost-effectively as possible.

An advantage is that a horizontal footprint or horizontal dimensions, or dimensions perpendicular to an access door to the switch-fuse module of existing switchgear may be maintained within a prescribed limit. The equipment takes up as little floor space as possible or at least does not exceed the size of traditional units, thus enabling the customer to renew existing equipment without additional space requirements, preferably in combination with existing customer components.

An advantage is that a switch-fuse combination for eco-efficient gas insulating switchgear may be provided.

Further aspects, advantages and features of the present disclosure are apparent from the dependent claims, the description, and the accompanying drawings.

BRIEF DESCRIPTION OF THE DRAWINGS

So that the manner in which the above recited features of the present disclosure can be understood in detail, a more particular description of the present disclosure, briefly summarized above, may be had by reference to typical embodiments. The accompanying drawings relate to embodiments of the present disclosure and are described in the following.

DETAILED DESCRIPTION

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described.

The reference numbers of the figures are used merely for illustration. The aspects of the invention are not limited to any particular embodiment. Instead, any aspect or embodiment described herein can be combined with any other aspect or embodiment described herein unless specified otherwise.

Figure 2:
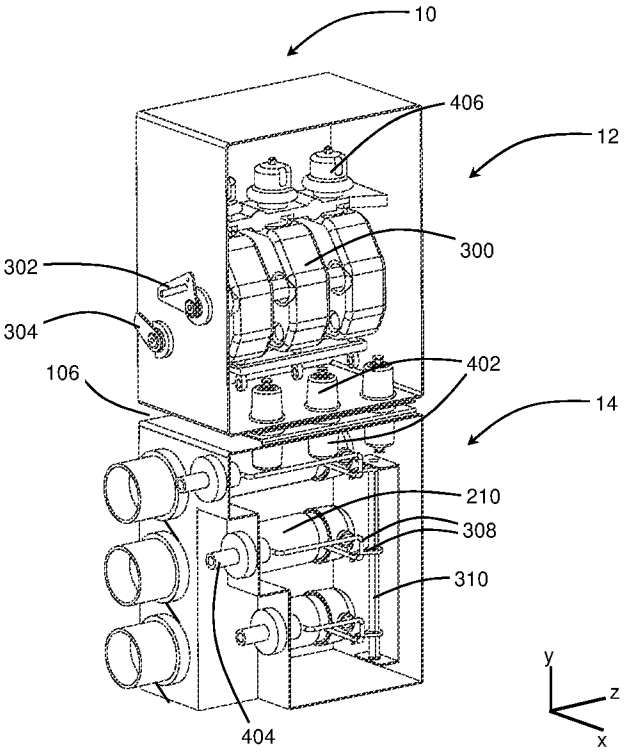
FIG. 2 shows a perspective 3D view of a switch-fuse module according to embodiments described herein.
Figure 1:
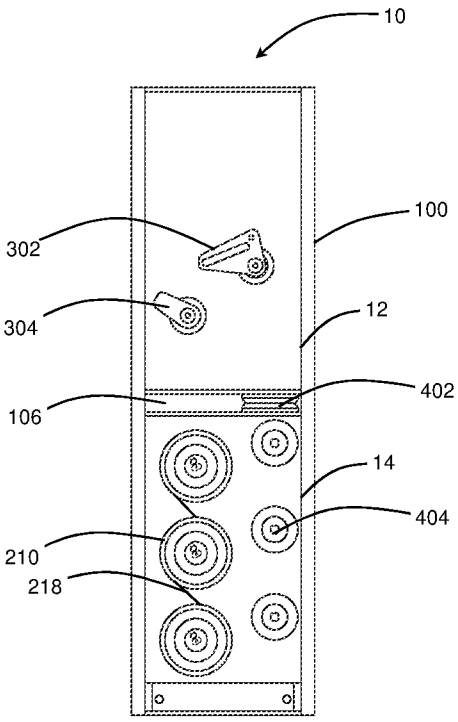
FIG. 1 shows a schematic front view of a switch-fuse module according to embodiments described herein.

FIGS. 1, 2 show schematic views of a switch-fuse module according to embodiments of the present invention. FIG. 1 shows a front view, and FIG. 2 shows a perspective 3D view of a switch-fuse module, wherein some additional typical parts like actuators, levers, motors, canister lids are omitted in the Figure for the sake of clarity. Details explained with illustrative reference to FIGS. 1, 2 shall not be understood as limited to the elements of FIGS. 1, 2. Rather, those details may also be combined with further embodiments explained with illustrative reference to the other figures.

According to embodiments described herein, a switch-fuse module 10 may include: a housing 100 having therein a switch compartment 12 including a first insulating gas and a fuse compartment 14 including a second insulating gas, at least one switch disconnector 300 arranged within the switch compartment 12, and at least one fuse 200 at least partially surrounded by the fuse compartment 14. The switch compartment 12 may be referred to as first enclosure and the fuse compartment 14 may be referred to as second enclosure. Each of the first insulating gas and the second insulating gas may have a global warming potential less than a global warming potential of SF6. The switch compartment 12 may be different and separate from the fuse compartment 14.

According to an embodiment, a cross-section transversal to the fuse axis of the fuse 200 can be defined in which the fuse 200 is (completely) surrounded by the fuse compartment 14. According to an embodiment, a cylindrical side wall of the fuse 200 may be surrounded by the fuse compartment 14. The fuse 200 may be provided in an opening (closed hole or through-hole) of the fuse compartment 14. The fuse 200 itself does not need to be included in the inner volume of the fuse compartment 14, and may be filled with the same gas or with a different gas (e.g., ambient air at atmospheric pressure) than the dielectric gas inside the fuse compartment 14.

According to embodiments described herein, a ring main unit (not shown in the figures) may include the switch-fuse module 10.

A technical effect of the switch compartment 12 being different and separate from the fuse compartment 14 consists in that existing production lines for known standard components such as those normally used with SF6 can be used for manufacturing the present equipment. This is beneficial based on that the present equipment can be manufactured without additional costs in production, which may well secure competitive advantages.

Another technical effect of the switch compartment 12 being different and separate from the fuse compartment 14 consists in that pressure conditions and gas compositions in the respective compartments can be separately established and controlled. This effect is beneficial based on improved control options of the respective compartments depending on the technical requirements, and/or increased flexibility in terms of tailoring to customer requirements.

Another technical effect of the switch compartment 12 being different and separate from the fuse compartment 14 consists in a modular concept resulting in improved maintenance and service options. If a problem occurs in one unit, only that unit needs to be dealt with in terms of repair or replacement and the other remains unaffected.

Figure 3:
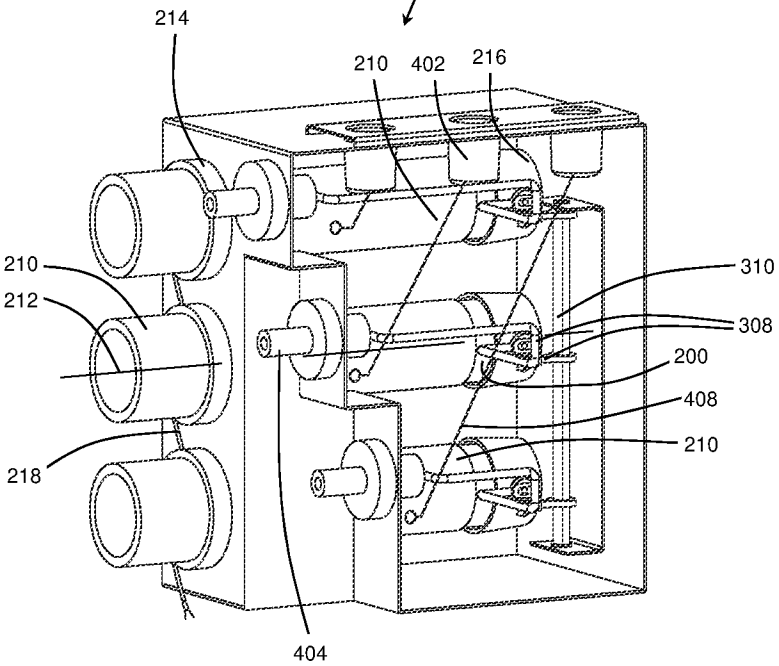
FIG. 3 shows a perspective 3D view of a fuse compartment according to embodiments described herein.

FIG. 3 shows a perspective 3D view of a fuse compartment 14 according to embodiments described herein. Details explained with illustrative reference to FIG. 3 shall not be understood as limited to the elements of FIG. 3. Rather, those details may also be combined with further embodiments explained with illustrative reference to the other figures.

Aspects and embodiments of the present invention are described with reference to FIGS. 1-3. Unless specified otherwise, the description of a part or aspect in one embodiment applies to a corresponding part or aspect in another embodiment as well.

According to embodiments, the switch compartment 12 and the fuse compartment 14 may be arranged adjacently, preferably spaced from each other at a first distance. The first distance may be at least 2 mm, 5 mm, or 10 mm, up to at most 20 mm, 40 mm, or 100 mm.

According to embodiments, the switch compartment 12 may be arranged vertically above the fuse compartment 14. This arrangement advantageously makes it possible to keep to a minimum the horizontal footprint, i.e. the horizontal extension of the switch-fuse module 10 corresponding to the projection of the switch-fuse module 10 on the horizontal x-z plane, while at same time fully maintaining the structural stability or steadiness of the equipment.

According to embodiments, the switch disconnector 300 may be configured as a load-break switch (LBS). Especially, the switch disconnector 300 may be configured as an integrated two-position load break switch plus a separate, second earthing switch including an earthing shaft. The switch disconnector 300 may have two shafts: i) one shaft is operable by a handle 302 and is used to open or close the main line, and ii) the other shaft is operable by a handle 304 and is used to open or earth the main line. The switch disconnector 300 may be generally configured as described in EP 3780055 A1, reference numeral 700.

According to embodiments, the switch-fuse module 10 may include least one canister 210 or fuse canister configured for receiving the fuse 200.

According to embodiments, the fuse 200 may be arranged in the canister 210. The canister 210 may be shaped as an elongated, cylindrical body and/or may be horizontally arranged. The longitudinal axis 212 of cylindrical canister 210 body may be horizontal.

According to embodiments, the fuse 200 may be electrically connected at a first end 214 to the switch disconnector 300 via an internal bushing 402 passing from the switch compartment 12 into the fuse compartment 14. Herein, the internal bushing 402 may pass vertically through horizontal enclosure walls of the fuse compartment 14 and of the switch compartment 12. The first fuse end and a canister area covering the first fuse end are both addressed by the reference sign 214.

According to embodiments, the fuse 200 may be electrically connected at a second end 216 to a connector bushing 404. The second fuse end and a canister area covering the second fuse end are both addressed by the reference sign 216.

According to embodiments, the connector bushing 404 may be arranged laterally adjacent to the fuse 200.

According to embodiments, the switch-fuse module 10 may include a second earthing switch that is arranged in the switch compartment 12 between the internal bushing 402 and the switch disconnector 300.

According to embodiments, the at least one fuse may include three fuses 200. Preferably, each of the three fuses 200 can be connected to one of three current phases. According to embodiments, the switch-fuse module is an AC switch-fuse module.

According to embodiments, the at least one canister 210 may include three canisters 210. Each canister 210 may receive one fuse 200.

According to embodiments, the switch-fuse module 10 may include at least one internal bushing 402 and/or at least one connector bushing 404. The at least one internal bushing may include three internal bushings 402. The at least one connector bushing may include three connector bushings 404.

According to embodiments, each of the three fuses 200 may have a longitudinal axis, that preferably may coincide with the respective fuse axis 212. The axes i) may be arranged basically in one plane, preferably a vertical plane, and/or ii) may be arranged parallel to each other, and/or iii) may be horizontally oriented.

According to embodiments, the connector bushings 404 may be successively staggered against each other, and/or arranged in a stair-like manner. For example, the connector bushings 404 may be parallel to each other (with their axes parallel to each other) and/or arranged along a common vertical connector bushings plane (in FIG. 1: z-y plane), but at different horizontal positions (preferably different horizontal positions along their axis, in FIG. 1: different z positions), preferably in an equidistantly staggered manner. According to embodiments, the bushings 404 may penetrate a staircase-formed side wall of the fuse compartment 14. According to embodiments, the fuses 200 may be parallel to each other (with their axes parallel to each other and preferably with their axes parallel to the axes of the bushings) and/or arranged along a common vertical fuse plane, preferably parallel to the connector bushings plane. The fuse plane and the connector bushings plane may be spaced apart from each other in a horizontal direction perpendicular to the fuse axes and/or to the connector busing axes.

This arrangement has the beneficial effect of i) allowing electrical connections to be guided vertically downwards, i.e. towards a lower area or standing area of the switch-fuse module 10 or of the housing 100, ii) allowing electrical connections to be arranged next to each other and to preferably run vertically and side-by-side in the lower area of the switch-fuse module 10, and/or iii) allowing a space-saving arrangement of components.

Further, the connector bushings 404 may be accessible by a human operator from the same side as the first canister 210 ends, to insert or replace the fuses 200 and/or canisters 210.

According to embodiments, the first insulating gas and second insulating gas may be the same. Alternatively, the first insulating gas and second insulating may be different.

According to embodiments, the first insulating gas and second insulating gas may have the same pressure. Alternatively, the first insulating gas and second insulating gas may have different pressures According to embodiments, the switch compartment 12 and the fuse compartment 14 may be gas-tight with respect to each other. That means that the switch compartment 12 and fuse compartment 14 may be isolated from each other in a gas-tight manner.

This effects the possibility that pressure conditions and gas compositions in the respective compartments are separately established and controlled. This effect is beneficial based on improved control options of the respective compartments depending on the technical requirements, and/or increased flexibility in terms of tailoring to customer requirements.

According to embodiments, the first gas and the second gas may have each a dielectric strength lower than the dielectric strength of SF6.

According to embodiments, the switch-fuse module 10 may further include a first earthing switch 308 for earthing the second end 216 of the fuse 200, and at least one earthing shaft 310 for operating the first earthing switch 308 and the second earthing switch (and possibly a third earthing switch). The first earthing switch 308 may be arranged in the fuse compartment, and may for example be mounted laterally to the fuse 200, e.g., at the first end 214 of the fuse 200.

A plurality of first earthing switches 308 may be arranged, one for each fuse 200. The earthing switches may be actuated by a common earthing shaft 310, thus enabling the first earthing switches 308 to earth the fuses 200 (specifically, their second ends 216) simultaneously. The first earthing switch 308 may be arranged downstream of fuse 200 within the fuse compartment 14. The second earthing switch (not shown; arranged at or below the switch disconnector 300) may be arranged upstream of fuse 200 within the switch compartment 12. In this document, upstream and downstream are related to the direction from switch disconnector 300 to fuse 200.

Further, a thin metal cylinder may be molded inside a wall of the fuse canister, wherein the wall is earthed. The fuse canister 120 may have two connection points, wherein each connection point is connected to a respective end 214, 216 of the fuse 200. The first ends 214 of fuse canisters 210 are isolated from the fuse ends, and are interconnected to each other by means of a canister earthing cable 218 which is configured as an earthing wire for shielding the canister.

According to embodiments, the fuse compartment 14 may be configured as a pressurised tank.

According to embodiments, the switch-fuse module 10 may be configured for a rated voltage in a range from 1 kV to 52 kV.

According to embodiments, the switch-fuse module 10 may include at least one busbar arranged at a second distance above the housing of switch compartment 12, wherein the second distance is at least a distance dielectrically suitable for a rated voltage in a range from 1 kV to 52 kV in the presence of the first insulating gas.

Some embodiments relating to the geometry and dimensions of the switch-fuse module 10 are described as follows.

The switch-fuse module 10 and/or ring main unit including the switch-fuse module 10 may have a height of more than 1000 mm and/or less than 1750 mm, or alternatively more than 1000 mm and/or less than 2000 mm. For example, the switch-fuse module 10 may have a height of less than 1750 mm.

The switch-fuse module 10 and/or ring main unit may have a depth of more than 500 mm and/or less than 850 mm, or alternatively more than 500 mm and/or less than 1000 mm. For example, the switch-fuse module 10 may have a depth of less than 850 mm.

The switch-fuse module 10 and/or ring main unit may have a width of more than 300 mm and/or less than 800 mm, or alternatively more than 300 mm and/or less than 1000 mm. For example, the switch-fuse module 10 may have a width of less than 800 mm.

It may be understood that a larger switch-fuse module 10 and/or ring main unit dimensions may be suitable for a higher rated voltage. For example, a switch-fuse module 10 and/or a ring main unit may be for a rated voltage in a range from 1 kV or 12 kV to 24 kV, with a height of more than 1000 mm and/or less than 1750 mm, depth of more than 500 mm and/or less than 850, and/or width of more than 300 mm and/or less than 800 mm, while a switch-fuse module 10 and/or a ring main unit may be for a rated voltage in a range from 36 kV to 42 kV, with a height of more than 1000 mm and/or less than 2000 mm, depth of more than 500 mm and/or less than 1000, and/or width of more than 400 mm and/or less than 1000 mm.

Some embodiments relating to the fuse 200 and switch-disconnector are described as follows.

In some embodiments, up to five switches, e.g. disconnector-switches, and/or panels, e.g. general panels, may be included in the switch compartment 12.

The fuse canister 210 may be designed as moulded fuse canister. The fuse 200, the moulded fuse canister 210 and/or the electrical connection may be arranged in such a way that they forward the busbar to the next or an adjacent panel of the switchgear.

A puffer switching device may be utilised as the switch-disconnector. Alternatively, a puffer switching device may be utilised in addition to the switch-disconnector. Alternatively, a vacuum interrupter may be utilised. The puffer switching device may include a fixed tulip contact. The fixed tulip contact may be connected to the busbar.

The puffer switching device may include a linearly sliding electrode, a blowing compression chamber, and/or blowing ports. The puffer switching device may include a rotating shaft to disconnect the line, which may be a load break shaft for example. The switch compartment 12 may cover the load break shaft of the panel.

Some embodiments relating to the insulating gases are described as follows.

The switch compartment 12 and the fuse compartment 14 may each be configured as a pressurized tank containing the first and second insulating gas with dielectric strength lower than dielectric strength of SF6. The pressurized tank may be configured to be filled, for example during installation and/or commissioning, to an absolute pressure in a range from 1.0 bar to 2.0 bar, preferably in a range from 1.3 bar to 1.4 bar.

Global warming potential may be understood to be assessed over an interval of 100 years, relative to CO2 gas. SF6 may be considered to have a global warming potential of 22,200 times that of CO2 over a 100-year period. The insulating gases having dielectric strength lower than dielectric strength of SF6 include at least one gas component selected from the group consisting of: CO2, O2, N2, H2, air, N2O, a hydrocarbon, in particular CH4, a perfluorinated or partially hydrogenated organofluorine compound, and mixtures thereof. In further embodiments, the insulating gases include a background gas, in particular selected from the group consisting of: CO2, O2, N2, H2, air, in a mixture with an organofluorine compound selected from the group consisting of: fluoroether, oxirane, fluoramine, fluoroketone, fluoroolefin, fluoronitrile, and mixtures and/or decomposition products thereof. For example, the insulating gases may include dry air or technical air. Each of the insulating gases may be a dielectric insulating medium. The insulating gases may in particular include an organofluorine compound selected from the group consisting of: a fluoroether, an oxirane, a fluoramine, a fluoroketone, a fluoroolefin, a fluoronitrile, and mixtures and/or decomposition products thereof. In particular, the insulating gases may include as a hydrocarbon at least CH4, a perfluorinated and/or partially hydrogenated organofluorine compound, and mixtures thereof. The organofluorine compound is preferably selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. The insulating gases preferably includes the fluoroketone mixed with air or an air component such as N2, O2, and/or CO2.

In specific cases, the fluoronitrile mentioned above is a perfluoronitrile, in particular a perfluoronitrile containing two carbon atoms, and/or three carbon atoms, and/or four carbon atoms. More particularly, the fluoronitrile can be a perfluoroalkylnitrile, specifically perfluoroacetonitrile, perfluoropropionitrile (C2F5CN) and/or perfluorobutyronitrile (C3F7CN). Most particularly, the fluoronitrile can be perfluoroisobutyronitrile (according to formula (CF3)2CFCN) and/or perfluoro-2-methoxypropanenitrile (according to formula CF3CF(OCF3)CN). Of these, perfluoroisobutyronitrile is particularly preferred due to its low toxicity.

As an example, the switch-fuse module 10 can operate with air, dry air, and/or a gas mixture including air for a rated voltage in a range from 1 kV to 52 kV, for example 12 kV or a 12 kV rated switchgear. In another example, the switch-fuse module 10 can operate with a gas mixture including a C5 perfluoroketone and/or air, for a rated voltage in a range from 1 kV to 52 kV, for example 24 kV or a 24 kV rated switchgear.

Some embodiments relating to the first earthing switch 308 and second earthing switch are described hereinafter.

The first earthing switch 308 may be vertically mounted in the fuse compartment 14. The first earthing switch 308 may include two contact elements 308, wherein a stationary contact element is adapted to receive a movable (e.g., fork-shaped) contact element for closing the switch. The movable contact element may be rotatably moved around earthing shaft 310 to open the earthing switch 308 when separating from the stationary contact, or to close the switch when being moved in the closing direction. The movement of the rotatable contact element can be carried out by means of vertically arranged earthing shaft 310. The first earthing switch 308 may be configured to earth a second (downstream) fuse end 216.

The second earthing switch may be mounted in the switch compartment 12, e.g., below the switch disconnector 300. The second earthing switch may be configured for earthing the first (upstream) fuse end 214. The first and/or second fuse end 214, 216 may be an electrical conductive side of the fuse 200.

An electrical connector 408 (shown schematically in FIG. 3 but not shown in FIG. 2) may connect the first fuse end 214 to the switch disconnector 300 via internal bushing 402.

The earthing shaft 310 may be configured for operating the first earthing switch 308. A further earthing shaft (not shown; coupled operating member 304) may be configured for operating the second earthing switch. The earthing shaft 310 and/or the further earthing shaft may simultaneously operate a respective plurality of first earthing switches 308 and second earthing switches, respectively. The first earthing switch 308 and the second earthing switch may be configured to be operated simultaneously and/or jointly connected to a common actuating mechanism. Thereby, both upstream and downstream of the fuse 200 may be simultaneously grounded.

Some embodiments relating to elements of the switch-fuse module 10 are described as follows.

The switch-fuse module 10 may be configured for a rated voltage in a range from 1 kV to 52 kV, or from 1 kV to 42 kV, or from 10 kV to 42 kV, or from 12 kV to 42 kV, or for 12 kV and 24 kV and/or 36 kV and/or 40.5 kV. In one particular example, it may be understood that a 24 kV rated unit may fulfil dielectric withstand of at least 125 kV lightning impulse.

The switch-fuse module 10 may include at least one busbar. In an example, the busbar may be a metallic strip or bar, and/or may be housed inside a switchgear, a panel board, and/or busway enclosures, and in some examples, suitable for local and/or high current power distribution and/or suitable for connecting high voltage equipment. The busbar may be arranged substantially parallel to a vertical plane that includes the switch-disconnector, and/or in a horizontal direction or alternatively in a vertical direction, and/or perpendicular to a central axis 212 of the fuse 200.

The busbar may be mounted above the fuse 200 and/or the switch-disconnector. The busbar may be a long connection (for example, a busbar adapted for interconnecting a plurality of panels or switchboards such as the switch-fuse module), or a short connection (for example, a busbar section interconnecting the switch-disconnector with a third bushing, wherein the third bushing may be connected to a line or to a further busbar section; in FIG. 2, only a connection 406 to the third bushing is shown).

The switch-fuse module 10 may be adapted to protect a transformer that may be part of an electrical network.

The switch-fuse 200 module 10 may be interconnected, e.g., via a busbar, to further panels and/or switchboards interconnected by the busbar, thereby constituting a switchgear including the panels and/or switchboards including the switch-fuse module 10. The switch fuse module may be an outermost panel of a switchgear. Where the switch-fuse module 10 is the outermost panel of a switchgear, top and side bushings may be mounted. A positioning of components such as the fuse 200, the electrical linkage, the busbar and/or the switch-disconnector may provide the needed dielectric strength. The external surface of conductive materials may be configured to provide the needed dielectric strength.

According to aspects described herein, a ring main unit may be provided. The ring main unit may have a switch-fuse module 10 according to aspects and/or embodiments described herein.

This written description uses examples to disclose the disclosure, including the best mode, and also to enable any person skilled in the art to practice the described subject-matter, including making and using any apparatus or system. Embodiments described herein provide an improved switch-fuse module and ring main unit, wherein environmentally friendly gases are used as dielectric medium, the equipment can be economically manufactured, and increased flexibility in terms of tailoring to customer requirements is provided. While various specific embodiments have been disclosed in the foregoing, mutually non-exclusive features of the embodiments described above may be combined with each other. The patentable scope is defined by the claims, and other examples are intended to be within the scope of the claims if they have structural elements that do not differ from the literal language of the claims, or if they include equivalent structural elements with insubstantial differences from the literal language of the claims.

The invention claimed is:

1. A switch-fuse module comprising:

a housing having therein a first enclosure comprising a first insulating gas and a second enclosure comprising a second insulating gas;

at least one switch disconnector arranged within the first enclosure; and at least one fuse at least partially surrounded by the second enclosure;

wherein each of the first insulating gas and the second insulating gas has a global warming potential less than a global warming potential of SF6, and the first enclosure is different and separate from the second enclosure, wherein the first enclosure and the second enclosure are isolated from each other in a gas-tight manner.

2. The switch-fuse module according to claim 1, wherein the first enclosure is arranged vertically above the second enclosure.

3. The switch-fuse module according to claim 1, wherein the second enclosure is configured as a pressurised tank.

4. The switch-fuse module according to claim 1, wherein the switch-fuse module comprises at least one canister; and the fuse is arranged in the canister.

5. The switch-fuse module according to claim 4, wherein the canister is horizontally arranged, or a longitudinal axis of a cylindrical body of the canister is horizontal.

6. The switch-fuse module according to claim 1, wherein the fuse is electrically connected at a first end to the switch disconnector via an internal bushing passing from the first enclosure into the second enclosure, especially the internal bushing passing vertically through horizontal enclosure walls.

7. The switch-fuse module according claim 6, further comprising a first earthing switch arranged in the second enclosure for earthing a second end of the fuse; and a second earthing switch arranged in the first enclosure between the internal bushing and the switch disconnector for earthing the first end of the fuse.

8. The switch-fuse module according to claim 7, further comprising at least one earthing shaft for operating the first earthing switch and the second earthing switch simultaneously.

9. The switch-fuse module according to claim 6, wherein the fuse is electrically connected at a second end to a connector bushing, and the connector bushing is arranged laterally adjacent to the fuse.

10. The switch-fuse module according to claim 1, wherein the at least one fuse comprises three fuses;

each of the three fuses is connected to one of three current phases; and each of the three fuses has a longitudinal axis.

11. The switch-fuse module according to claim 10, wherein the axes are arranged in one plane and are arranged parallel to each other.

12. The switch-fuse module according to claim 10, wherein the axes are horizontally oriented, and the axes are arranged in a vertical plane.

13. The switch-fuse module according to claim 1, wherein the at least one canister comprises three canisters, each canister receiving one fuse.

14. The switch-fuse module according to claim 1, wherein the switch-fuse module comprises three internal bushings, and three connector bushings.

15. The switch-fuse module according to claim 14, wherein the connector bushings, are successively staggered relative to each other, arranged in a stair-shaped manner, and accessible by a human operator from the same side as the first fuse ends.

16. The switch-fuse module according to claim 1, wherein the first gas and the second gas have each a dielectric strength lower than a dielectric strength of SF6.

17. The switch-fuse module according to claim 1, wherein the switch disconnector is configured as a load-break switch.

18. The switch-fuse module according to claim 1, wherein the switch-fuse module is configured for a rated voltage in a range from 1 kV to 52 kV.

19. The switch-fuse module according to claim 18, wherein the fuse is configured to be accessible from a front of the switch-fuse module.

20. The switch-fuse module according to claim 1, wherein a pressure condition in the second enclosure is separately controlled from a pressure condition in the first enclosure.

21. A ring main unit comprising a switch-fuse module including:

a housing having therein a first enclosure comprising a first insulating gas and a second enclosure comprising a second insulating gas;

at least one switch disconnector arranged within the first enclosure; and at least one fuse at least partially surrounded by the second enclosure;

wherein each of the first insulating gas and the second insulating gas has a global warming potential less than a global warming potential of SF6, and the first enclosure is different and separate from the second enclosure, wherein the first enclosure and the second enclosure are isolated from each other in a gas-tight manner.

* * * * *